US012359394B2

(12) United States Patent
Pandey et al.

(10) Patent No.: US 12,359,394 B2
(45) Date of Patent: Jul. 15, 2025

(54) WORK VEHICLE

(71) Applicant: Hitachi Construction Machinery Co., Ltd., Tokyo (JP)

(72) Inventors: Jyotsna Pandey, Tokyo (JP); Youko Tsukada, Tokyo (JP); Masanori Ichinose, Tokyo (JP); Masaki Higurashi, Ibaraki (JP); Yoshiaki Tsutsumi, Ibaraki (JP); Shouta Fujiyoshi, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 278 days.

(21) Appl. No.: 18/023,916

(22) PCT Filed: Dec. 13, 2021

(86) PCT No.: PCT/JP2021/045841
§ 371 (c)(1),
(2) Date: Feb. 28, 2023

(87) PCT Pub. No.: WO2022/158168
PCT Pub. Date: Jul. 28, 2022

(65) Prior Publication Data

US 2023/0323625 A1 Oct. 12, 2023

(30) Foreign Application Priority Data

Jan. 21, 2021 (JP) ..... 2021-007690

(51) Int. Cl.
*E02F 3/43* (2006.01)
*E02F 3/42* (2006.01)
*E02F 9/22* (2006.01)

(52) U.S. Cl.
CPC ..... *E02F 3/431* (2013.01); *E02F 3/422* (2013.01); *E02F 9/2203* (2013.01);
(Continued)

(58) Field of Classification Search
CPC ..... E02F 3/434; E02F 9/265; E02F 9/0841; E02F 9/2004; E02F 9/22; E02F 3/43; E02F 3/431; B66F 9/0655; B60W 20/13
See application file for complete search history.

(56) References Cited

U.S. PATENT DOCUMENTS

2016/0040391 A1 2/2016 Imaizumi et al.
2016/0230369 A1* 8/2016 Kaneko ..... B60W 20/13
(Continued)

FOREIGN PATENT DOCUMENTS

JP 2020-169508 A 10/2020
WO WO 2015/004809 A1 1/2015
WO WO 2016/006716 A1 1/2016

OTHER PUBLICATIONS

International Search Report (PCT/ISA/210) issued in PCT Application No. PCT/JP2021/045841 dated Feb. 15, 2022 with English translation (five (5) pages).
(Continued)

*Primary Examiner* — Yuri Kan
(74) *Attorney, Agent, or Firm* — Crowell & Moring LLP

(57) ABSTRACT

Provided is a work vehicle capable of excavating an excavation object efficiently and in various excavation patterns with appropriate fuel efficiency, regardless of the operator's skill level. The work vehicle includes a controller. The controller executes control including insertion control, acceleration control, and deceleration control. The insertion control keeps the tilt amount (stroke amount S2) of the bucket and increases the lift amount (stroke amount S1) of the lift arm in the insertion period Ph1 from the timing when the work vehicle meets an entry condition for object, where the acceleration α of the vehicle becomes negative, to the timing when the acceleration α first becomes positive. The acceleration control keeps the tilt amount and increases the lift amount if the acceleration condition that the acceleration
(Continued)

α becomes positive is met in the lift period Ph2 from the timing when the work vehicle first meets the insertion condition to the timing when the end condition is met, where the lift amount and the tilt amount reach their specified values. The deceleration control keeps the lift amount and increases the tilt amount when the deceleration condition that the acceleration α becomes negative is met in the lift period Ph2.

8 Claims, 5 Drawing Sheets

(52) U.S. Cl.
CPC ..... *E02F 9/2267* (2013.01); *E02F 9/2271* (2013.01); *E02F 9/2285* (2013.01); *E02F 9/2292* (2013.01)

(56) References Cited

U.S. PATENT DOCUMENTS

| | | | | |
|---|---|---|---|---|
| 2017/0037594 | A1* | 2/2017 | Wada | E02F 3/43 |
| 2019/0100899 | A1* | 4/2019 | Kimura | E02F 9/22 |
| 2019/0169009 | A1* | 6/2019 | Gales | B66F 9/0655 |
| 2019/0360169 | A1* | 11/2019 | Tinker | E02F 9/2004 |
| 2021/0047801 | A1* | 2/2021 | Tanaka | E02F 9/0841 |
| 2022/0081871 | A1* | 3/2022 | Oasa | E02F 9/265 |

OTHER PUBLICATIONS

Japanese-language Written Opinion (PCT/ISA/237) issued in PCT Application No. PCT/JP2021/045841 dated Feb. 15, 2022 (three (3) pages).

* cited by examiner

WORK VEHICLE

TECHNICAL FIELD

The present disclosure relates to work vehicles such as a wheel loader that performs excavation work.

BACKGROUND ART

Wheel loaders have been known as work vehicles for excavation work, and automatic control for the vehicle is disclosed for the purpose of achieving production efficiency similar to that of a skilled operator, regardless of the operator's skill level. Specifically, the disclosed automatic control for bucket starts the tilt operation of the bucket when a predetermined condition is met, and ends the tilt operation based on the amount of increase in lift force from the start of the tilt operation. This literature also discloses automatic control for lift arm that starts the lift-arm raising operation based on the lift force, vehicle speed, and lift-arm angle and ends the raising operation based on the amount of increase in lift force or lift-arm angle from the start of lift-arm raising operation (see Patent Literature 1).

CITATION LIST

Patent Literature

Patent Literature 1: WO 2015/004809

SUMMARY OF INVENTION

Technical Problem

When excavating natural ground with a work vehicle such as a wheel loader, various excavation patterns are required for the excavation, such as deep penetration into the ground, medium penetration into the ground, or shallow penetration into the ground, and an excavation object must be excavated with appropriate fuel efficiency. The automatic control with the conventional work machine described above, however, ends the tilt operation of the bucket and the lift-arm raising operation based on a predetermined increase in lift force. Thus, this control enables automatic execution of a single excavation pattern, but fails to execute various excavation patterns automatically as described above. If the excavation pattern is fixed to one in this way, the work machine will fail to excavate an excavation object with various excavation patterns.

The present invention aims to provide a work vehicle capable of excavating an excavation object efficiently and in various excavation patterns with appropriate fuel efficiency, regardless of the operator's skill level.

Solution to Problem

One aspect of the present disclosure is a work vehicle including: a vehicle body; a lift arm having one end side pivotably attached to the vehicle body; a bucket pivotably attached to the other end side of the lift arm; an acceleration sensor that detects acceleration of the vehicle body; a lift-amount detection sensor that detects lift amount of the lift arm; a tilt-amount detection sensor that detects tilt amount of the bucket; and a controller that controls the bucket and the lift arm. The controller keeps the tilt amount detected by the tilt-amount detection sensor while increasing the lift amount in an insertion period from the timing when the work vehicle meets an entry condition to an excavation object, where acceleration detected by the acceleration sensor becomes negative, to the timing when the work vehicle meets an insertion condition to the excavation object, where acceleration detected by the acceleration sensor first becomes positive, the controller keeps the tilt amount while increasing the lift amount when an acceleration condition that the acceleration becomes positive is met in a lift period from the timing when the work vehicle first meets the insertion condition to the timing when an end condition where lift amount detected by the lift-amount detection sensor and tilt amount detected by the tilt-amount detection sensor reach respective specified values is met, and the controller keeps the lift amount while increasing the tilt amount when a deceleration condition that the acceleration becomes negative is met in the lift period.

Advantageous Effects of Invention

According to the above-described aspect of the present disclosure, a work vehicle is provided, which is capable of excavating an excavation object efficiently and in various excavation patterns with appropriate fuel efficiency, regardless of the operator's skill level.

DESCRIPTION OF EMBODIMENTS

The following describes an embodiment of a work vehicle according to the present disclosure, with reference to the drawings.

Figure 1:
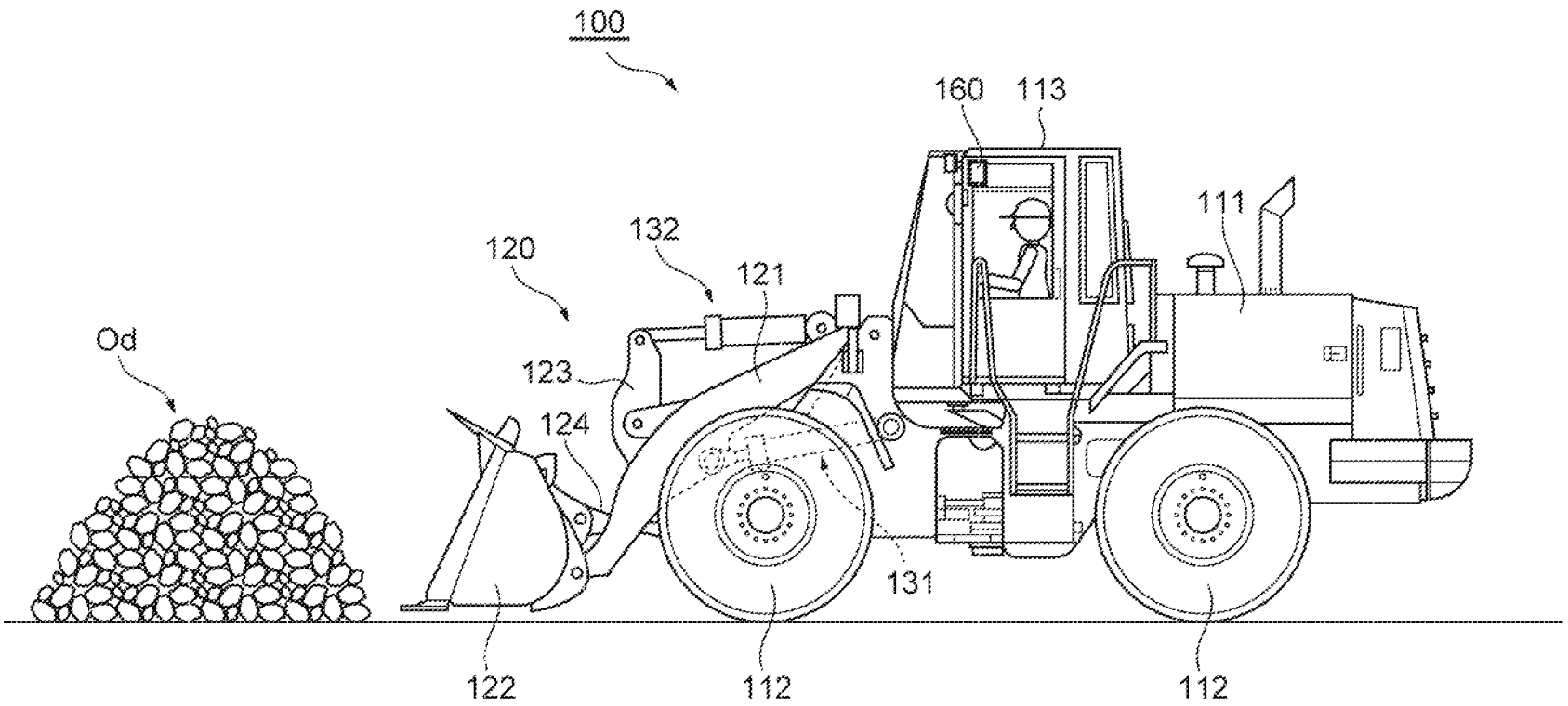
FIG. 1 is a side view showing an embodiment of a work vehicle according to the present disclosure.
Figure 2:
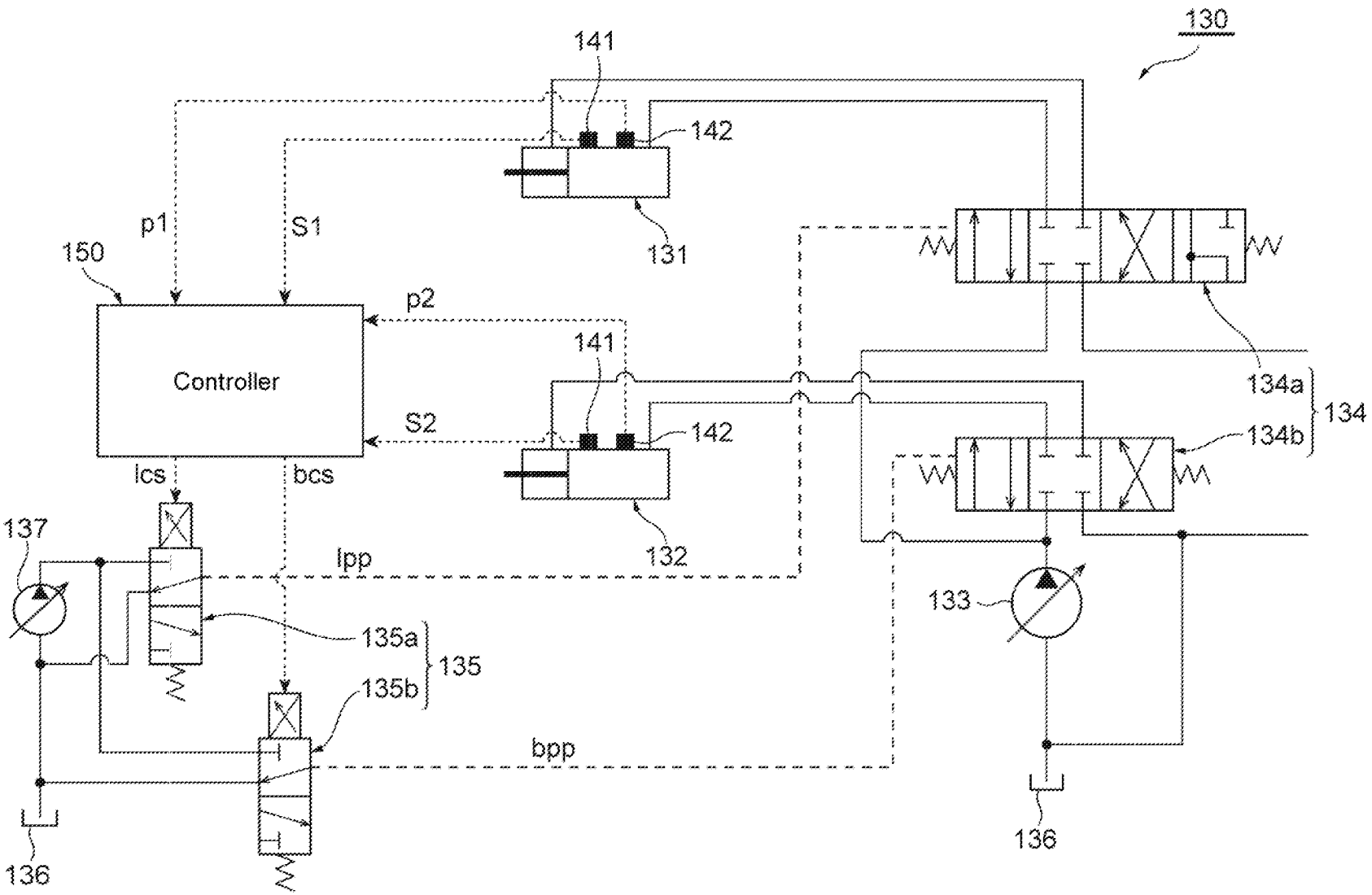
FIG. 2 is a schematic circuit diagram of a portion of a hydraulic system mounted on the work vehicle shown in FIG. 1.
Figure 3:
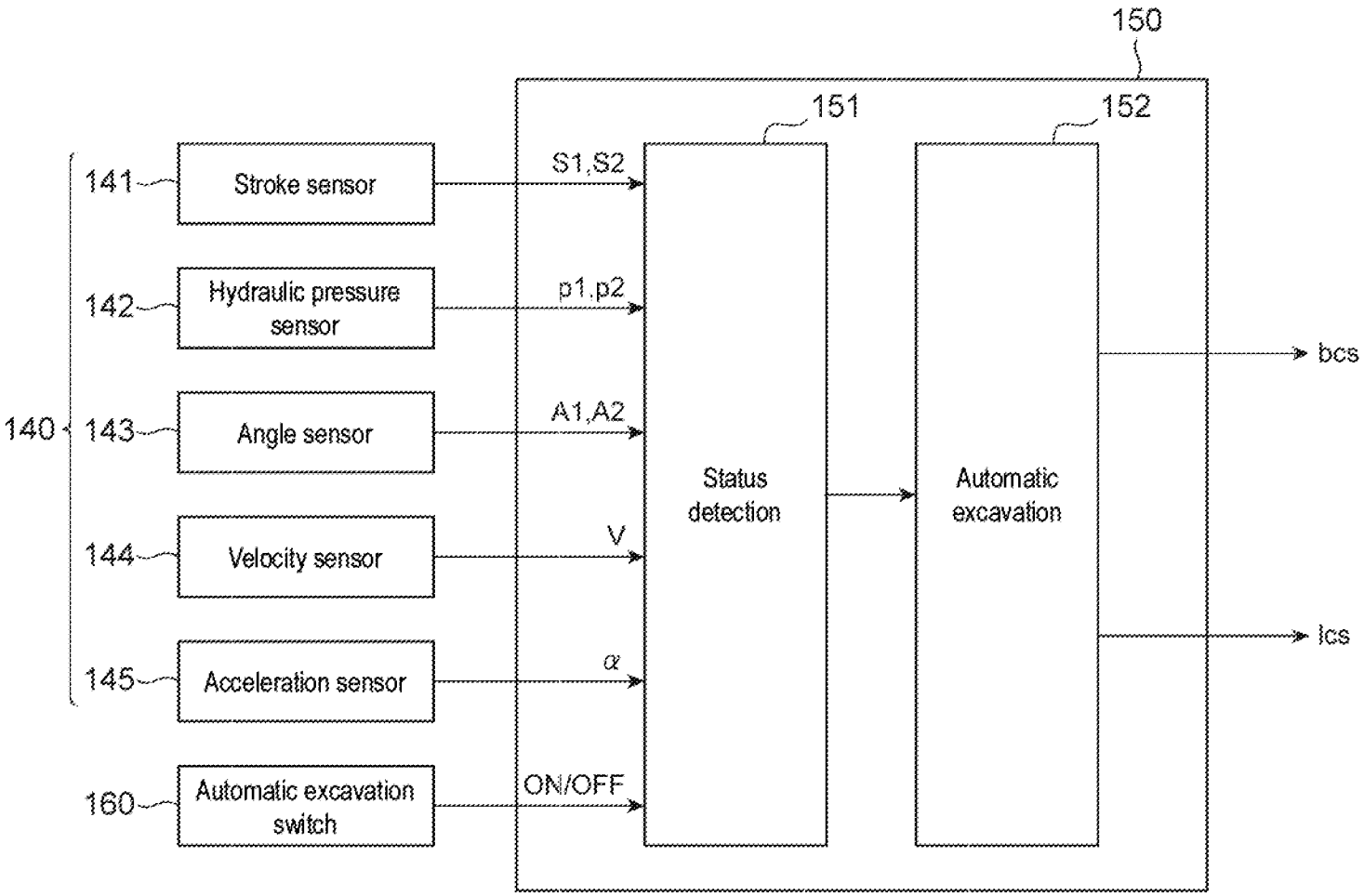
FIG. 3 is a functional block diagram of a controller mounted on the work vehicle shown in FIG. 1.

FIG. 1 is a side view showing one embodiment of a work vehicle according to the present disclosure. FIG. 2 is a schematic circuit diagram of a portion of a hydraulic system 130 mounted on the work vehicle 100 shown in FIG. 1. FIG. 3 is a functional block diagram of a controller 150 mounted on the work vehicle 100 shown in FIG. 1. In FIG. 2, solid lines indicate the fluid path, dashed lines indicate the pilot pressure path, and dotted lines indicate the electrical signal path.

The work vehicle 100 of the present embodiment is a wheel loader that excavates an excavation object Od such as crushed stones, soil and ores deposited on the ground surface, and loads the excavation object Od onto the back of a transporter vehicle such as a dump truck. For instance, the work vehicle 100 includes a vehicle body 111 having a front frame and a rear frame that are pin-connected to each other, a work machine 120, a hydraulic system 130, a detection device 140, and the controller 150. The work vehicle 100 is not limited to a wheel loader, which may be any other work vehicles or work machines such as a loading shovel.

The rear frame includes wheels 112 and a cabin 113, for example. In addition to the hydraulic system 130 and controller 150, an engine, a transmission, a fuel tank (they are not shown) and other components are mounted in the structure cover of the rear frame. For instance, the wheels 112 are connected to the engine via the transmission, and are driven by the rotation of the engine via the transmission to cause the vehicle body 111 to run.

The cabin 113 is a compartment located behind the work machine 120 at the front of the vehicle body 111. Although not illustrated, a seat for an operator to board as well as an operation lever, a brake pedal, an accelerator pedal, a display device, a speaker, a switch, a display lamp, instruments, and other components are placed in the cabin 113. For instance, the work vehicle 100 of this embodiment includes an automatic excavation switch 160 in the cabin 113 for executing control AD by the controller 150.

For instance, the work machine 120 includes a lift arm 121 attached to the front of the vehicle body 111 and a bucket 122 attached to the distal end of the lift arm 121 that is opposite the proximal end attached to the vehicle body 111 to excavate and lift the excavation object Od. The work machine 120 also includes a bellcrank 123 and a bucket link 124 for driving the bucket 122. Although not shown, the work machine 120 includes a pair of left and right lift arms 121 spaced apart in the width direction of vehicle body 111.

For instance, the hydraulic system 130 is mounted inside the vehicle body 111. As shown in FIG. 2, the hydraulic system 130 includes a lift cylinder 131, a bucket cylinder 132, a pump 133, a directional control valve 134, a pilot valve 135, a reservoir 136, and a pilot pump 137.

For instance, the lift cylinder 131 and bucket cylinder 132 are hydraulic cylinders. For instance, the pump 133 and pilot pump 137 are hydraulic pumps driven by the engine. For instance, the directional control valve 134 includes a lift control valve 134*a* and a bucket control valve 134*b*. For instance, the pilot valve 135 includes a lift pilot valve 135*a* and a bucket pilot valve 135*b*. For instance, the reservoir 136 stores fluid such as hydraulic oil.

For instance, as shown in FIG. 1, the lift cylinder 131 has a piston rod with the distal end connected to the lower end of the middle portion of the lift arm 121 and a cylinder tube with the proximal end, opposite the piston rod, connected to the front of the vehicle body 111. Although not shown, the work vehicle 100 includes a pair of left and right lift cylinders 131 on both sides of the vehicle body 111 in the width direction, for example.

When extended, the lift cylinder 131 rotates the lift arm 121 upward around the rotary shaft attached to the vehicle body 111. This increases the lift amount of the lift arm 121 and thus lifts the bucket 122 at the distal end of the lift arm 121. When retracted, the lift cylinder 131 rotates the lift arm 121 downward around the rotary shaft attached to the vehicle body 111. This decreases the lift amount of the lift arm 121 and thus lowers the bucket 122 attached to the distal end of the lift arm 121.

For instance, as shown in FIG. 1, the bucket cylinder 132 is placed between the pair of lift arms 121. For instance, the bucket cylinder 132 has a piston rod with the distal end connected to the bucket 122 via the bellcrank 123 and bucket link 124, and a cylinder tube with the proximal end, opposite the piston rod, connected to the vehicle body 111. For instance, the bellcrank 123 is supported by a connection connecting the centers of the left and right lift arms 121 as a pair.

When extended, the bucket cylinder 132 rotates the bucket 122 upward around the rotary shaft attached to the distal end of the lift arm 121 via the bellcrank 123 and bucket link 124. This increases the tilt amount of the bucket 122, causing the opening of the bucket 122 to face upward and allowing the bucket 122 to scoop the excavation object Od.

When retracted, the bucket cylinder 132 rotates the bucket 122 downward around the rotary shaft attached to the lift arm 121 via the bellcrank 123 and bucket link 124. This decreases the tilt amount of the bucket 122, causing the opening of the bucket to face downward and allowing the bucket 122 to dump the excavation object Od scooped by the bucket 122 to the outside.

As shown in FIG. 2, the pump 133 delivers fluid to extend and retract the lift cylinder 131 and bucket cylinder 132. For instance, the pump 133 delivers fluid such as hydraulic oil stored in the reservoir 136 toward the bottom side of the cylinder tubes of the lift cylinder 131 and bucket cylinder 132 via the directional control valve 134 to extend their piston rods. The pump 133 also delivers the fluid toward the rod side of the cylinder tubes of the lift cylinder 131 and bucket cylinder 132 via the directional control valve 134 to retract their piston rods.

The directional control valve 134 controls the flow rate of fluid to be supplied to the lift cylinder 131 and bucket cylinder 132 in accordance with the lift pilot pressure lpp and bucket pilot pressure bpp generated by the pilot valve 135. Specifically, the lift control valve 134*a* controls the flow rate of fluid to be supplied to the bottom or rod side of the cylinder tube of the lift cylinder 131 in accordance with the lift pilot pressure lpp generated by the lift pilot valve 135*a*. The bucket control valve 134*b* controls the flow rate of fluid to be supplied to the bottom or rod side of the cylinder tube of the bucket cylinder 132 in accordance with the bucket pilot pressure bpp generated by the bucket pilot valve 135*b*.

The pilot valve 135 is connected to the directional control valve 134 and generates lift pilot pressure lpp and bucket pilot pressure bpp in accordance with the control by controller 150. Specifically, the lift pilot valve 135*a* is connected to the lift control valve 134*a* and generates lift pilot pressure lpp in accordance with control signal lcs input from the controller 150. The bucket pilot valve 135*b* is connected to the bucket control valve 134*b* and generates bucket pilot pressure bpp in accordance with control signal bcs input from the controller 150.

Specifically, the lift pilot valve 135*a* generates the lift pilot pressures lpp on the right and left of the lift control valve 134*a* to supply fluid from the pump 133 to the rod and bottom sides of the cylinder tube of the lift cylinder 131. The bucket pilot valve 135*b* generates the bucket pilot pressures bpp on the right and left of the bucket control valve 134*b* to supply fluid from the pump 133 to the rod and bottom sides of the cylinder tube of the bucket cylinder 132.

The pilot pump 137 delivers fluid from the reservoir 136 to the pilot valve 135 to generate lift pilot pressure lpp and bucket pilot pressure bpp, which are input to the directional control valve 134 via the pilot valve 135. Specifically, the pilot pump 137 delivers fluid to the lift pilot valve 135*a* and the bucket pilot valve 135*b* to generate the lift pilot pressure lpp and the bucket pilot pressure bpp to be input to the lift control valve 134*a* and the bucket control valve 134*b*, respectively.

For instance, as shown in FIGS. 2 and 3, the detection device 140 includes a stroke sensor 141, a hydraulic pressure sensor 142, an angle sensor 143, a velocity sensor 144, and an acceleration sensor 145. Note that in the work vehicle 100 of the present embodiment, the detection device 140 may include at least the stroke sensor 141 or the angle sensor 143, and the acceleration sensor 145. The detection device 140 may also include a position sensor that detects the position of the vehicle body 111, such as a global navigation satellite system (GNSS).

For instance, the stroke sensor 141 is placed at each of the lift cylinder 131 and the bucket cylinder 132 to detect the stroke amounts S1 and S2 of the piston rods of the lift cylinder 131 and the bucket cylinder 132 respectively, and transmits their detection results to the controller 150. Each of the lift cylinder 131 and the bucket cylinder 132 is provided with the hydraulic pressure sensor 142 that detects the fluid pressures p1 and p2 on the bottom side of the cylinder tubes of the lift cylinder 131 and the bucket cylinder 132 respectively, and they transmit their detection results to the controller 150.

For instance, the angle sensor 143 is mounted in the connection between the lift arm 121 and the vehicle body 111, and the connection between the lift arm 121 and the bellcrank 123, respectively. For instance, the angle sensor 143 detects the rotation angle A1 of the lift cylinder 131 relative to the vehicle body 111 and transmits the detection result to the detection device 140. For instance, the angle sensor 143 detects the rotation angle A2 of the bellcrank 123 relative to the lift arm 121 and transmits the detection result to the detection device 140.

For instance, the velocity sensor 144 is mounted on the vehicle body 111, and detects the velocity V of the vehicle body 111 and transmits the detection result to the controller 150. For instance, the velocity sensor 144 measures the angular velocity of the wheels 112 to calculate the velocity V of the vehicle body 111, and transmits the detection result to the controller 150. For instance, the acceleration sensor 145 is mounted on the vehicle body 111, and detects the acceleration $\alpha$ of the vehicle body 111 and transmits the detection result to the controller 150. Alternatively, for instance, the velocity sensor 144 may calculate the velocity V of the work vehicle 100 by integrating the acceleration $\alpha$ of the vehicle body 111 detected by the acceleration sensor 145.

The controller 150 is a computer system such as firmware and a microcontroller mounted on the vehicle body 111, and executes control AD (see FIG. 4) to drive the bucket 122 and the lift arm 121 to excavate the excavation object Od. For instance, the controller 150 includes an arithmetic device such as a central processing unit (CPU), a memory device such as RAM and ROM, programs stored in that memory device, a timer, and an input/output device, which are not shown in the drawing.

For instance, as shown in FIG. 3, the controller 150 has a status detection function 151 and an automatic excavation function 152. For instance, these functions of the controller 150 are implemented by executing a program stored in the memory device by the arithmetic device of the controller 150. The status detection function 151 detects the status of the work vehicle 100 based on information input from the detection device 140.

Specifically, the status detection function 151 calculates the lift amount of the lift arm 121 based on the stroke amount S1 of the lift cylinder 131 input from the stroke sensor 141, for example, and outputs the result to the automatic excavation function 152. For instance, the lift amount is the rotation angle or height of the lift arm 121 relative to the most retracted state of the lift cylinder 131. For instance, the status detection function 151 may calculate the lift amount based on the rotation angle A1 of the lift arm 121 relative to the vehicle body 111 that is input from the angle sensor 143.

For instance, the status detection function 151 calculates the tilt amount of the bucket 122 based on the stroke amount S2 of the bucket cylinder 132 that is input from the stroke sensor 141 and outputs the result to the automatic excavation function 152. For instance, the tilt amount is the rotation angle of the bucket 122 relative to the most retracted state of the bucket cylinder 132. For instance, the status detection function 151 may calculate the tilt amount based on the rotation angle A2 of the bellcrank 123 relative to the lift arm 121 and the rotation angle A1 of the lift arm 121 relative to the vehicle body 111, which are input from the angle sensor 143.

For instance, the status detection function 151 may calculate the load acting on the work machine 120 based on the lift and tilt amounts and the pressures p1 and p2 of the liquid on the bottom sides of the lift cylinder 131 and bucket cylinder 132, which are input from the hydraulic pressure sensor 142. For instance, the status detection function 151 outputs the calculated load to the automatic excavation function 152.

For instance, the status detection function 151 may output the information input from the stroke sensor 141, the hydraulic pressure sensor 142, the angle sensor 143, the velocity sensor 144, and the acceleration sensor 145 as the status of the work vehicle 100 to the automatic excavation function 152. That is, the status detection function 151 may acquire the information such as the stroke amounts S1, S2, the pressures p1, p2, the rotation angles A1, A2, the velocity V, and the acceleration $\alpha$ that are input from the detection device 140, for example, and output the information to the automatic excavation function 152.

The work vehicle 100 of the present embodiment includes the automatic excavation switch 160 as described above. In this case, the status detection function 151 receives an on or off state from the automatic excavation switch 160, for example. The status detection function 151 may detect the input on or off state of the automatic excavation switch 160 and output the detection result to the automatic excavation function 152.

For instance, the automatic excavation function 152 receives information on the status of the work vehicle 100 including the acceleration $\alpha$ of the vehicle body 111, the lift amount of the lift arm 121, and the tilt amount of the bucket 122 from the status detection function 151. For instance, based on the input information, the automatic excavation function 152 executes control AD that drives the lift arm 121 and bucket 122 to excavate the excavation object Od.

Figure 4:
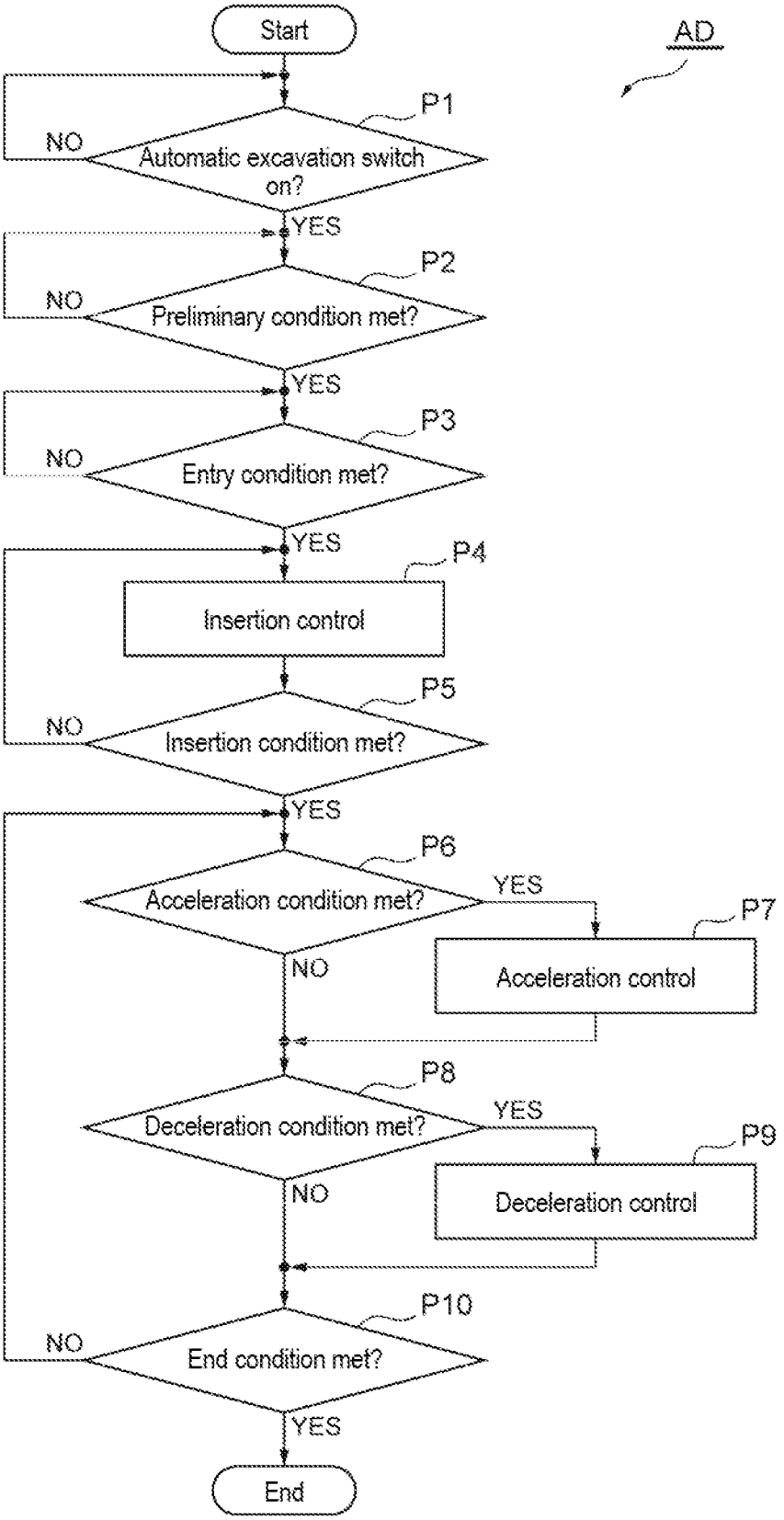
FIG. 4 is a flowchart showing the control performed by the controller shown in FIG. 3.
Figure 5:
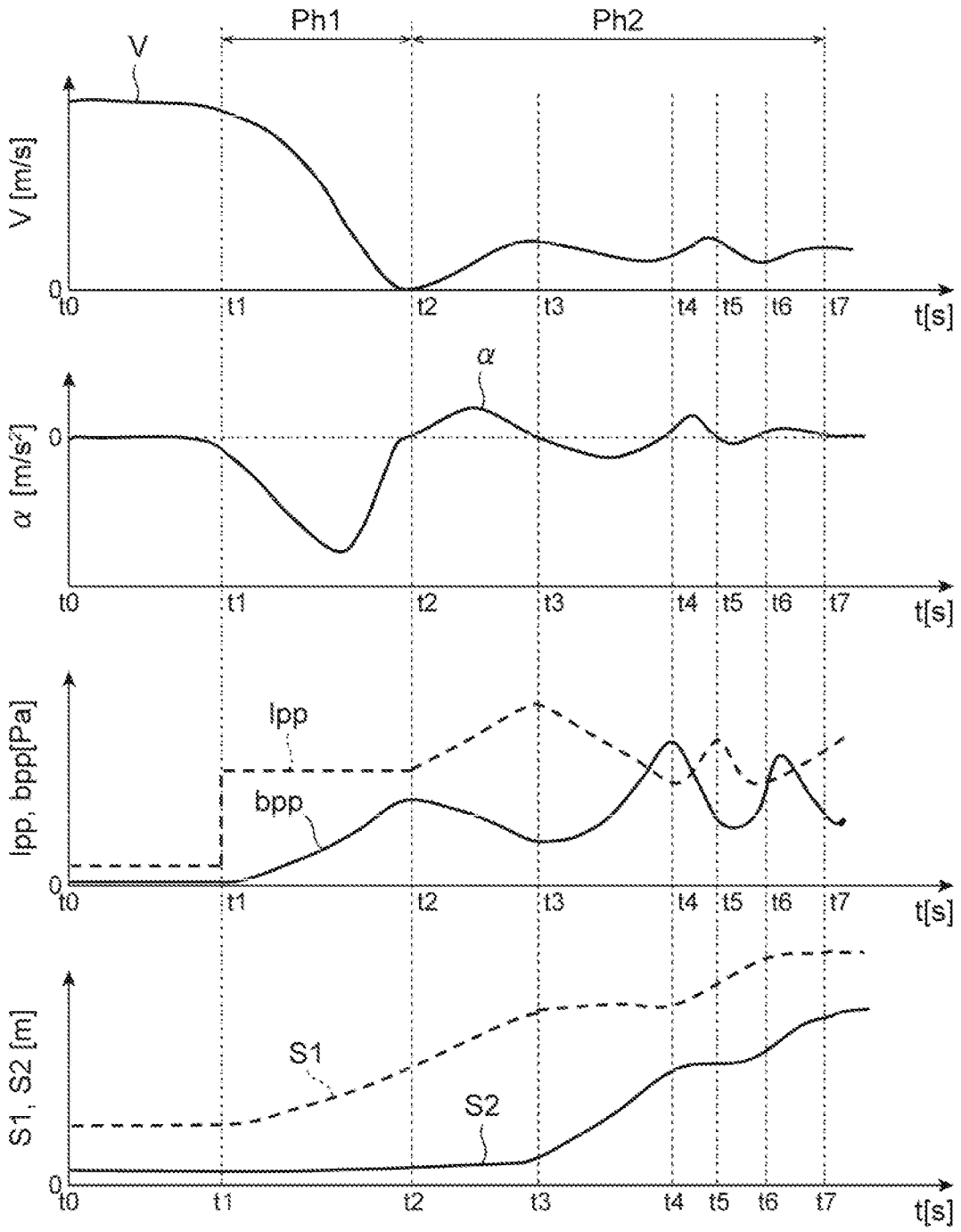
FIG. 5 is a graph showing the status of the work vehicle when the control shown in FIG. 4 is executed.

FIG. 4 is a flowchart showing one example of the control AD performed by the controller 150. FIG. 5 is a graph showing the status of the work vehicle 100 when the control AD is executed. The horizontal axis of each graph in FIG. 5 represents time t [s]. The vertical axes of the graphs in FIG. 5 represent velocity V [m/s], acceleration $\alpha$ [m/s$^2$], lift pilot pressure lpp and bucket pilot pressure bpp [Pa], and stroke amounts S1, S2 [m] of the lift cylinder 131 and bucket cylinder 132 from the top to the bottom.

The following is a detailed description of the control AD performed by the controller 150. For instance, the controller 150 causes the automatic excavation function 152 to execute a determination process P1 that determines whether or not the automatic excavation switch 160 is on. In this determination process P1, if the automatic excavation switch 160 is off, the automatic excavation function 152 determines that the condition is not met (NO) and repeats the determination process P1 at a predetermined cycle.

That is, if the automatic excavation switch 160 is off, the controller 150 does not perform automatic control AD, and the work vehicle 100 operates in response to manual operation by the operator. Note that when the work vehicle 100 does not have the automatic excavation switch 160, the determination process P1 can be omitted.

If the automatic excavation switch 160 is on in the determination process P1, the automatic excavation function 152 determines that the condition is met (YES). In this case, the automatic excavation function 152 executes a process to change the status of the work vehicle 100 to "automatic excavation on" or to display on the display device in the cabin 113 that the control AD is on (not shown in the drawing), for example, and then executes the next determination process P2.

For instance, in the determination process P2, the controller 150 causes the automatic excavation function 152 to determine whether or not a predetermined preliminary condition is met. Specifically, the automatic excavation function 152 determines that the preliminary condition is met if the velocity V of the work vehicle 100, the lift amount of the lift arm 121, and the tilt amount of the bucket 122 are each within a predetermined range, for example.

Specifically, the predetermined range of the velocity V for satisfying the preliminary condition can be set to a range necessary for letting the teeth of the bucket 122 enter the excavation object Od, as shown in FIG. 1, for example. The predetermined ranges of the lift and tilt amounts for satisfying the preliminary condition can be set to a range so as to lower the lift arm 121 and direct the teeth of the bucket 122 toward the excavation object Od, as shown in FIG. 1, for example.

For instance, the preliminary condition may include that the pressure p1 of the fluid on the bottom side of the cylinder tube of the lift cylinder 131 is in a predetermined range. The preliminary condition also may include that the stroke amounts S1, S2 of the piston rods of the lift cylinder 131 and the bucket cylinder 132 are in a predetermined range. The preliminary condition also may include that the displacement of the brake pedal by the operator is in a predetermined range.

The preliminary condition also may include that the displacement of the accelerator pedal by the operator is in a predetermined range. The preliminary condition also may include that the transmission gear of the vehicle body 111 is in a predetermined range. The preliminary condition also may include that the lift pilot pressure lpp and bucket pilot pressure bpp are in a predetermined range. The preliminary condition also may include that the torque of the engine of the vehicle body 111 is in a predetermined range.

In the determination process P2, if the automatic excavation function 152 determines that the work vehicle 100 does not meet the predetermined condition (NO), the controller 150 repeats the determination process P2 at a predetermined cycle. Let that at time t0 shown in FIG. 5, for example, the work vehicle 100 meets the preliminary condition. At this time t0, the work vehicle 100 is traveling toward the excavation object Od at a substantially constant velocity V with the lift arm 121 lowered and the teeth of the bucket 122 facing the excavation object Od.

Then, in the determination process P2, the controller 150 causes the automatic excavation function 152 to determine that the work vehicle 100 meets the preliminary condition (YES). In this case, the automatic excavation function 152 executes a process to change the status of the work vehicle 100 to a preliminary status and a process to display on the display device in the cabin 113 that the status is the preliminary status (not shown in the drawing), for example, and then executes the next determination process P3.

For instance, in the determination process P3, the controller 150 causes the automatic excavation function 152 to determine whether or not a predetermined entry condition is met. Specifically, the automatic excavation function 152 determines that the entry condition is met when the acceleration α of the vehicle body 111 moving toward the excavation object Od becomes negative, for example. For instance, the entry condition may also include that the pressure p1 of the fluid on the bottom side of the cylinder tube of the lift cylinder 131 is in a predetermined range.

In the example shown in FIG. 5, from time t0 before time t1, the work vehicle 100 travels toward the excavation object Od at substantially constant velocity V, and the acceleration α is approximately zero. In this case, in the determination process P3, the controller 150 causes the automatic excavation function 152 to determine that the predetermined entry condition is not met (NO), for example. In this case, the automatic excavation function 152 repeatedly executes the determination process P3 at a predetermined cycle, for example. To prevent erroneous determination of the entry condition, it may be determined that the entry condition is met when the acceleration α becomes equal to or less than a predetermined negative threshold value.

In the example shown in FIG. 5, the teeth of the bucket 122 of the work vehicle 100 enters the excavation object Od just before time t1, so that velocity V decreases and acceleration α becomes negative. Then, in the determination process P3, the controller 150 causes the automatic excavation function 152 to determine that the predetermine entry condition is met (YES), and executes an insertion control P4 to increase the lift amount of the lift arm 121 while keeping the tilt amount of the bucket 122.

Specifically, for instance, when the insertion control P4 starts at time t1, the controller 150 causes the automatic excavation function 152 to generate a lift pilot pressure lpp that can increase the lift amount and keep that lift pilot pressure lpp. More specifically, in accordance with the status of the work vehicle 100 detected by the status detection function 151, the controller 150 causes the automatic excavation function 152 to output a control signal lcs to the lift pilot valve 135*a* shown in FIG. 2.

In accordance with the control signal lcs, the lift pilot valve 135*a* generates a predetermined lift pilot pressure lpp at time t1, for example, as shown in FIG. 5, and keeps the lift pilot pressure lpp during the insertion control P4 from time t1. This allows the fluid delivered by the pump 133 from the reservoir 136 shown in FIG. 2 to flow into the bottom side of the cylinder tube of the lift cylinder 131 at a predetermined flow rate through the lift control valve 134*a*.

As a result, as shown in FIG. 5, for example, the controller 150 increases the stroke amount S1 of the piston rod of the lift cylinder 131 by the insertion control P4 executed in the insertion period Ph1 from the time t1, thus increasing the lift amount of the lift arm 121.

For instance, when the insertion control P4 starts at time t1, the controller 150 causes the automatic excavation function 152 to increase the bucket pilot pressure bpp within a range of keeping the tilt amount of the bucket 122. Specifically, in accordance with the status of the work vehicle 100 detected by the status detection function 151, the controller 150 causes the automatic excavation function 152 to output a control signal bcs to the bucket pilot valve 135*b* shown in FIG. 2.

In accordance with the control signal bcs from the controller 150, the bucket pilot valve 135*b* increases the bucket pilot pressure bpp within a predetermined range in the insertion period Ph1 from time t1, for example, as shown in FIG. 5. This allows the pressure of fluid on the bottom side of the cylinder tube of the bucket cylinder 132 shown in FIG.

2 to increase with the pressure of the fluid delivered by the pump 133 via the lift control valve 134*a*.

However, as shown in FIG. 5, for example, this pressure of the fluid does not increase the stroke amount S2 of the piston rod of the bucket cylinder 132 in the insertion control P4 executed during the insertion period Ph1. As a result, the insertion control P4 does not change the tilt amount of the bucket 122, and keeps the state of directing the teeth of the bucket 122 forward in the traveling direction of the vehicle body 111.

In other words, the controller 150 executes the insertion control P4 during the insertion period Ph1 from time t1, when the entry condition is met, where the acceleration α of the vehicle body 111 moving toward the excavation object Od becomes negative, to time t2, when the insertion condition is met, where the acceleration α first becomes positive. The insertion control P4 is a control to keep the tilt amount of the bucket 122 while increasing the lift amount of the lift arm 121.

With this insertion control P4, after the bucket 122 enters the excavation object Od at time t1 shown in FIG. 5 with its teeth directed toward the excavation object Od in the traveling direction as shown in FIG. 1, for example, the work vehicle 100 still moves forward while decelerating. During the insertion period Ph1 from time t1 to time t2, the work vehicle 100 operates to insert the bucket 122 at the distal end of the lift arm 121 into the excavation object Od in the traveling direction, and also lift the excavation object Od with lift arm 121.

As a result, a downward reaction force acts from the excavation object Od to the lift arm 121 attached to the front of the vehicle body 111, and a downward force acts on the front part of the vehicle body 111 from the lift arm 121. Therefore, the front driving wheels of the front and rear wheels 112 of the vehicle body 111 are pressed against the ground, thus increasing the frictional force between the driving wheels and the ground, and suppressing the spinning of the driving wheels. As a result, the bucket 122 can be efficiently inserted into the excavation object Od, regardless of the skill level of the operator of the work vehicle 100, thus enhancing the fuel efficiency of the work vehicle 100.

For instance, the controller 150 may cause the automatic excavation function 152 to perform a process to change the status of the work vehicle 100 to an insertion status and a process to display on the display device in the cabin 113 that the status is the insertion status (not shown in the drawing). After the predetermined entry condition is met at time t1, the controller 150 executes the next determination process P5 while executing the insertion control P4.

For instance, in the determination process P5, the controller 150 causes the automatic excavation function 152 to determine whether or not an insertion condition is met, where the insertion condition is that the acceleration α first becomes positive after the predetermined entry condition is met. In the example shown in FIG. 5, the work vehicle 100 decelerates while moving forward with the bucket 122 inserted into the excavation object Od from time t1 when the entry condition is met to time t2.

Therefore, in the example shown in FIG. 5, the acceleration α of the vehicle body 111 is negative during the insertion period Ph1 from time t1 to time t2. Therefore, in this insertion period Ph1, the controller 150 causes the automatic excavation function 152, for example, to determine that the insertion condition is not met (NO) in the determination process P5. In this case, the controller 150 continues the insertion control P4 by the automatic excavation function 152, and also repeatedly executes the determination process P5 at a predetermined cycle, for example.

In the example shown in FIG. 5, the work vehicle 100 ends the deceleration with the bucket 122 entering the excavation object Od to stop just before time t2, so that the velocity V and acceleration α of the vehicle body 111 become zero. After that, the operator of the work vehicle 100 moves the work vehicle 100 forward by operating the accelerator pedal, for example, and starts the work of scooping the excavation object Od with the work machine 120 and lifting it up.

As a result, in the example shown in FIG. 5, the velocity V of the vehicle body 111 increases, and the acceleration α increases and becomes positive at time t2. Then, in this determination process P5, the controller 150 causes the automatic excavation function 152, for example, to determine that the insertion condition is met (YES). At this time, the bucket 122 of the work vehicle 100 is fully inserted into the excavation object Od, for example.

That is, the period from time t1, when the entry condition is met, to time t2, when the insertion condition is met, is the insertion period Ph1 to insert the bucket 122, which entered the excavation object Od, deeper into the excavation object Od. In the determination process P5, if the controller 150 determines that the insertion condition is met (YES), the controller 150 ends the insertion control P4, and executes the next determination process P6.

In the example shown in FIG. 5, the period from t2 when the insertion condition is met to the time when an end condition is met, where the lift amount of the lift arm 121 and the tilt amount of the bucket 122 reach their respective specified values is a lift period Ph2 where the work vehicle 100 lifts the excavation object Od. For instance, in this lift period Ph2, the controller 150 first executes a determination process P6 to determine whether or not an acceleration condition is met, where the acceleration α of the vehicle body 111 becomes positive.

The acceleration α of the vehicle body 111 is positive immediately after the insertion condition is met in the determination process P5 described above. Therefore, in the determination process P6, the controller 150 causes the automatic excavation function 152, for example, to determine that the acceleration condition is met (YES), where the acceleration α of the vehicle body 111 becomes positive. In this case, the controller 150 executes acceleration control P7 that keeps the tilt amount of the bucket 122 while further increasing the lift amount of the lift arm 121.

Specifically, for instance, when the acceleration control P7 starts at time t2 shown in FIG. 5, the controller 150 controls the pilot valve 135 shown in FIG. 2 to decrease the bucket pilot pressure bpp in a rage of keeping the tilt amount of the bucket 122. At the same time, the controller 150 controls the pilot valve 135 shown in FIG. 2 to increase the lift pilot pressure lpp and thus further increase the lift amount of the lift arm 121.

Specifically, in accordance with the status of the work vehicle 100 detected by the status detection function 151, the controller 150 causes the automatic excavation function 152 to output a control signal bcs to the bucket pilot valve 135*b* shown in FIG. 2. In accordance with the control signal bcs, the bucket pilot valve 135*b* decreases the bucket pilot pressure bpp within a range of keeping the stroke amount S2 of the bucket cylinder 132 and keeping the tilt amount of the bucket 122, for example, as shown in FIG. 5.

In accordance with the status of the work vehicle 100 detected by the status detection function 151, the controller 150 also causes the automatic excavation function 152 to output a control signal lcs to the lift pilot valve 135*a* shown in FIG. 2. In accordance with the control signal lcs, the lift pilot valve 135*a* increases the lift pilot pressure lpp, for example, as shown in FIG. 5.

This allows the fluid delivered by the pump 133 from the reservoir 136 shown in FIG. 2 to flow into the bottom side of the cylinder tube of the lift cylinder 131 at a predetermined flow rate through the lift control valve 134*a*. As a result, as shown in FIG. 5, for example, the controller 150 further increases the stroke amount S1 of the piston rod of the lift cylinder 131 by the acceleration control P7 executed in the lift period Ph2 from the time t2. As a result, the controller 150 further increases the lift amount of the lift arm 121.

That is, the controller 150 executes the acceleration control P7 when the acceleration condition that the acceleration α of the vehicle body 111 becomes positive is met in the lift period Ph2 after the time t2 when the insertion condition is met. The acceleration control P7 is a control to keep the tilt amount of the bucket 122 while further increasing the lift amount of the lift arm 121.

For instance, if the insertion condition is met at time t2 shown in FIG. 5, the work vehicle 100 accelerates with the bucket 122 having the teeth directed forward in the traveling direction and fully inserted into the excavation object Od. This executes the acceleration control P7, whereby the controller 150 further increases the lift amount of the lift arm 121 while keeping the tilt amount of the bucket 122. As a result, the work vehicle 100 operate to push the bucket 122 at the distal end of the lift arm 121 into the excavation object Od in the traveling direction and also lift the excavation object Od with lift arm 121.

As a result, a downward reaction force acts from the excavation object Od to the lift arm 121 attached to the front of the vehicle body 111, and a downward force acts on the front part of the vehicle body 111 from the lift arm 121. Therefore, the front driving wheels of the front and rear wheels 112 of the vehicle body 111 are pressed against the ground, thus increasing the frictional force between the driving wheels and the ground, and suppressing the spinning of the driving wheels. As a result, the work vehicle 100 effectively scoops the excavation object Od with the bucket 122 and lifts it, regardless of the skill level of the operator of the work vehicle 100, thus enhancing the fuel efficiency of the work vehicle 100.

For instance, the controller 150 may cause the automatic excavation function 152 to perform a process to change the status of the work vehicle 100 to an acceleration status and a process to display on the display device in the cabin 113 that the status is the acceleration status (not shown in the drawing). After the acceleration condition is met at time t2, the controller 150 executes the next determination process P8 while continuing the acceleration control P7.

In the determination process P8, the controller 150 causes the automatic excavation function 152, for example, to determine whether or not a deceleration condition that the acceleration α of the vehicle body 111 becomes negative is met. In the example shown in FIG. 5, the acceleration α of the vehicle body 111 is positive from time t2 to time t3. Therefore, in the determination process P8 executed during this period, the controller 150 causes the automatic excavation function 152 to determine that the deceleration condition is not met (NO), for example. In this case, the controller 150 executes the next determination process P10.

In the example shown in FIG. 5, the acceleration α of the vehicle body 111 is negative at time t3. Therefore, in the determination process P8 executed at this time t3 or immediately after that, the controller 150 causes the automatic excavation function 152 to determine that the deceleration condition is met (YES), for example. In this case, the controller 150 executes deceleration control P9 that keeps the lift amount of the lift arm 121 while increasing the tilt amount of the bucket 122.

Specifically, for instance, when the deceleration control P9 starts at time t3 shown in FIG. 5, the controller 150 controls the pilot valve 135 shown in FIG. 2 to decrease the lift pilot pressure lpp in a rage of keeping the lift amount of the lift arm 121. At the same time, the controller 150 controls the pilot valve 135 shown in FIG. 2 to increase the bucket pilot pressure bpp and thus increase the tilt amount of the bucket 122.

More specifically, in accordance with the status of the work vehicle 100 detected by the status detection function 151, the controller 150 causes the automatic excavation function 152 to output a control signal lcs to the lift pilot valve 135*a* shown in FIG. 2. In accordance with the control signal lcs, the lift pilot valve 135*a* decreases the lift pilot pressure lpp within a range of keeping the stroke amount S1 of the lift cylinder 131 and keeping the lift amount of the lift arm 121, for example, as shown in FIG. 5.

In accordance with the status of the work vehicle 100 detected by the status detection function 151, the controller 150 also causes the automatic excavation function 152 to output a control signal bcs to the bucket pilot valve 135*b* shown in FIG. 2. In accordance with the control signal bcs, the bucket pilot valve 135*b* increases the bucket pilot pressure bpp, for example, as shown in FIG. 5.

This allows the fluid delivered by the pump 133 from the reservoir 136 shown in FIG. 2 to flow into the bottom side of the cylinder tube of the bucket cylinder 132 at a predetermined flow rate through the bucket control valve 134*b*. As a result, as shown in FIG. 5, for example, the controller 150 increases the stroke amount S2 of the piston rod of the bucket cylinder 132 by the deceleration control P9 executed in the lift period Ph2 from the time t3. As a result, the controller 150 increases the tilt amount of the bucket 122.

That is, the controller 150 executes the deceleration control P9 when the deceleration condition that the acceleration α of the vehicle body 111 becomes negative is met in the lift period Ph2 from the time t2 when the insertion condition is met. The deceleration control P9 is a control to keep the lift amount of the lift arm 121 while increasing the tilt amount of the bucket 122.

For instance, the controller 150 may cause the automatic excavation function 152 to perform a process to change the status of the work vehicle 100 to a deceleration status and a process to display on the display device in the cabin 113 that the status is the deceleration status (not shown in the drawing). After the deceleration condition is met at time t3, the controller 150 executes the next determination process P10 while continuing the deceleration control P9.

For instance, in the determination process P10, the controller 150 causes the automatic excavation function 152 to determine whether or not an end condition that the lift amount of the lift arm 121 and the tilt amount of the bucket 122 each reach a specified value is met. If the controller 150 determines that, in the determination process P10, the end condition is not met (NO), the controller 150 repeats the determination process P6, the acceleration control P7, the determination process P8, and the deceleration control P9 as described above. For instance, if the controller 150 determines that, in the determination process P10 from time t7 shown in FIG. 5, the end condition is met (YES), the controller 150 ends the control AD shown in FIG. 4.

For instance, although not shown in the drawing, after each processing shown in FIG. 4, the controller 150 may execute a stop determination process about whether or not a predetermined stop condition for the control AD is met, such as whether or not the automatic excavation switch 160 is turned off, or whether or not a sudden braking operation is performed. For instance, if the result of this stop determination processing is true, the controller 150 can stop the automatic control AD by the automatic excavation function 152 and switch the control of the work vehicle 100 to manual control by the operator.

As described above, the work vehicle 100 of the present embodiment includes the vehicle body 111, the lift arm 121 that is pivotably attached at one end side to the vehicle body 111, and a bucket 122 that is pivotably attached to the other end side of the lift arm 121. The work vehicle 100 also includes the acceleration sensor 145 to detect the acceleration α of the vehicle body 111, the stroke sensor 141 that is a lift-amount detection sensor to detect the lift amount of the lift arm 121, and the angle sensor 143 that is a tilt-amount detection sensor to detect the tilt amount of the bucket 122. The work vehicle 100 also includes the controller 150 that controls the bucket 122 and lift arm 121. The controller 150 executes the insertion control P4 to keep the tilt amount detected by the angle sensor 143 and increase the lift amount in the insertion period Ph1 from the timing when the work vehicle 100 meets the entry condition for the excavation object Od, where the acceleration α detected by the acceleration sensor 145 becomes negative to the timing when the work vehicle 100 meets the insertion condition, where the acceleration α detected by the acceleration sensor 145 first becomes positive. Further, the controller 150 executes the acceleration control P7 to keep the tilt amount and increase the lift amount if the acceleration condition that the acceleration α becomes positive is met in the lift period Ph2 from the timing when the work vehicle 100 first meets the insertion condition to the timing when the end condition is met, where the lift amount detected by the stroke sensor 141 and the tilt amount detected by the angle sensor 143 reach their specified values. Further, the controller 150 executes the deceleration control P9 to keep the lift amount and increase the tilt amount when the deceleration condition that the acceleration α becomes negative is met in the lift period Ph2.

With this configuration, the work vehicle 100 of the present embodiment is capable of excavating an excavation object Od efficiently and in various excavation patterns with appropriate fuel efficiency, regardless of the operator's skill level. Specifically, the insertion control P4 executed by the controller 150 increases the frictional force between the driving wheels of the work vehicle 100 and the ground surface during the insertion period Ph1, and thus efficiently inserts the bucket 122 into the excavation object Od. Further, the acceleration control P7 executed by the controller 150 increases the frictional force between the driving wheels of the work vehicle 100 and the ground surface during acceleration in the lift period Ph2, and thus efficiently scoops the excavation object Od with the bucket 122. Further, the deceleration control P9 executed by the controller 150 prevents a decrease in the frictional force between the driving wheels of the work vehicle 100 and the ground surface during deceleration in the lift period Ph2, and thus scoops the excavation object Od while tilting the bucket 122 efficiently. Thus, the work vehicle 100 of the present embodiment is capable of excavating an excavation object Od efficiently and with appropriate fuel efficiency, regardless of the operator's skill level.

The work vehicle 100 also allows the operator to change the magnitude of the acceleration α of the vehicle body 111 and the time of acceleration and deceleration, and thus automatically performs the control AD for various desired excavation patterns, such as shallow, medium, and deep excavations. That is, the control AD uses the acceleration α of the work vehicle 100 based on operator's operation as its control parameter for the control AD by the controller 150. This means that the excavation pattern of the control AD by controller 150 of the work vehicle 100 of the present embodiment is not limited to one fixed pattern. Thus, the present embodiment provides the work vehicle 100 capable of excavating an excavation object Od efficiently and in various excavation patterns with appropriate fuel efficiency, regardless of the operator's skill level.

In the work vehicle 100 of the present embodiment, the controller 150 starts the control AD when a predetermined preliminary condition is met, as in the determination process P2 of FIG. 4.

With this configuration, the controller 150 starts the automatic control AD only when the work vehicle 100 is in a state of enabling appropriate excavation of the excavation object Od. Specifically, for instance, even when the operator turns on the automatic excavation switch 160, they may operate the work vehicle 100 to climb a slope or move to another location, other than the operations of excavation or dumping of the excavation object Od. These cases can be set so that the predetermined preliminary condition is not met, whereby the controller 150 starts the automatic control AD only when the work vehicle 100 is ready and in an appropriate status.

The work vehicle 100 of the present embodiment further includes the velocity sensor 144 that detects velocity V of the vehicle body 111. For instance, the controller 150 determines that the preliminary condition is met if at least the velocity V detected by the velocity sensor 144, the lift amount detected by the stroke sensor 141 as the lift-amount detection sensor, and the tilt amount of the bucket 122 detected by the angle sensor 143 as the tilt-amount detection sensor are each within the predetermined range.

With this configuration, as shown in FIG. 1, for example, while having the appropriate posture with the lift arm 121 located downward and the teeth of the bucket 122 directed forward in the traveling direction of the work vehicle 100, the controller 150 of the work vehicle 100 starts the control AD. When the control AD by the controller 150 starts, the kinetic energy of the work vehicle 100 allows the bucket 122 to be inserted more reliably into the excavation object Od.

In the work vehicle 100 of the present embodiment, the controller 150 stops the control AD when a predetermined stop condition is met, for example. With this configuration, the work vehicle 100 stops the control AD in accordance with the intention of the operator of the work vehicle 100 and the circumstances around the work vehicle 100, and thus the safety of the work vehicle 100 improves.

The work vehicle 100 of the present embodiment includes the automatic excavation switch 160 to execute the control AD. The controller 150 then executes the control AD when the automatic excavation switch 160 is on. With this configuration, the controller 150 starts the control AD only when the operator of the work vehicle 100 turns the automatic excavation switch 160 on, thus preventing execution of the control AD against the operator's intention.

The work vehicle 100 in this embodiment includes the pump 133, which is a hydraulic pump that discharges pressure oil, the lift cylinder 131 that operates the lift arm 121 with the pressure oil discharged from the pump 133, the bucket cylinder 132 that operates the bucket 122 with the pressure oil discharged from the pump 133, and the pilot pump 137. The work vehicle 100 also includes the lift pilot valve 135*a*, which is a pilot valve 135 for lift arm operation that generates lift pilot pressure lpp that is pilot pressure for lift arm operation in response to a command from the controller 150, where the lift pilot pressure lpp is generated using pressure oil discharged from the pilot pump 137 as a pressure source. The work vehicle 100 also includes the bucket pilot valve 135*b*, which is a pilot valve 135 for bucket operation that generates bucket pilot pressure bpp that is pilot pressure for bucket operation in response to a command from the controller 150, where the bucket pilot pressure bpp is generated using pressure oil discharged from the pilot pump 137 as a pressure source. The work vehicle 100 also includes the lift control valve 134*a*, which is a directional control valve 134 for lift arm that controls the lift arm 121 in accordance with the lift pilot pressure lpp, and the bucket control valve 134*b*, which is a directional control valve 134 for bucket that controls the bucket 122 in accordance with the bucket pilot pressure bpp. Then, in the insertion period Ph1 from the timing when the work vehicle 100 meets the entry condition for the excavation object Od, where the acceleration α detected by the acceleration sensor 145 becomes negative, to the timing when the work vehicle 100 meets the insertion condition for the excavation object Od, where the acceleration α detected by the acceleration sensor 145 first becomes positive, the controller 150 increases the bucket pilot pressure bpp and also controls the lift pilot valve 135*a* so as to keep the lift pilot pressure lpp capable of increasing the lift amount. In the lift period Ph2, when the acceleration condition is met, the controller 150 controls the bucket pilot valve 135*b* so as to reduce the bucket pilot pressure bpp within a range capable of keeping the tilt amount, and also controls the bucket pilot valve 135*b* so as to increase the lift pilot pressure lpp and thus further increase the lift amount. In the lift period Ph2, when the deceleration condition is met, the controller 150 controls the lift pilot valve 135*a* so as to reduce the lift pilot pressure lpp within a range capable of keeping the lift amount, and also controls the bucket pilot valve 135*b* so as to increase the bucket pilot pressure bpp and thus increase the tilt amount.

With this configuration, the controller 150 controls the pilot valve 135 in the insertion period Ph1 to execute the insertion control P4 that keeps the tilt amount of the bucket 122 and increases the lift amount of the lift arm 121. In the lift period Ph2, when the acceleration condition is met, the controller 150 controls the pilot valve 135 so as to execute the acceleration control P7 that keeps the tilt amount of the bucket 122 and further increases the lift amount of the lift arm 121. In the lift period Ph2, when the deceleration condition is met, the controller 150 controls the pilot valve 135 so as to execute the deceleration control P9 that keeps the lift amount of the lift arm 121 and increases the tilt amount of the bucket 122. Thus, the work vehicle 100 of the present embodiment is capable of excavating an excavation object Od efficiently and in various excavation patterns with appropriate fuel efficiency, regardless of the operator's skill level.

In the work vehicle 100 of the present embodiment, the detection device 140 includes at least one of the angle sensor 143 that detects the rotation angle of the lift arm 121 relative to the vehicle body 111 and the stroke sensor 141 that detects the stroke amount S1 of the lift cylinder 131. The controller 150 calculates the lift amount of the lift arm 121 based on at least one of the rotation angle A1 of the lift arm 121 detected by the angle sensor 143 and the stroke amount S1 of the lift cylinder 131 detected by the stroke sensor 141. This configuration allows the lift amount of the lift arm 121 to be calculated using a typical detection device 140 that the work vehicle 100 includes.

The work vehicle 100 of the present embodiment includes at least one of the angle sensor 143 that detects the rotation angle of the bellcrank 123 relative to the lift arm 121 and the stroke sensor 141 that detects the stroke amount S2 of the bucket cylinder 132. Then, the controller 150 calculates the tilt amount of the bucket 122 based on at least one of the rotation angle A2 of the bellcrank 123 detected by the angle sensor 143 and the stroke amount S2 of the bucket cylinder 132 detected by the stroke sensor 141. This configuration allows the tilt amount of the bucket 122 to be calculated using a typical detection device 140 that the work vehicle 100 includes.

That is a detailed description of the embodiments of the work vehicle of the present disclosure, with reference to the drawings. The specific configuration of the present disclosure is not limited to the above-stated embodiments, and the design may be modified variously without departing from the spirits of the present disclosure. The present disclosure also covers such modified embodiments.

REFERENCE SIGNS LIST

100 Work vehicle
111 Vehicle body
121 Lift arm
122 Bucket
131 Lift cylinder
132 Bucket cylinder
133 Pump (hydraulic pump)
134 Directional control valve
134*a* Lift control valve (directional control valve for lift arm)
134*b* Bucket control valve (directional control valve for bucket)
135 Pilot valve
135*a* Lift pilot valve (pilot valve for lift arm operation)
135*b* Bucket pilot valve (pilot valve for bucket operation)
140 Detection device
141 Stroke sensor (lift-amount detection sensor)
143 Angle sensor (tilt-amount detection sensor)
144 Velocity sensor
150 Controller
160 Automatic excavation switch
A1 Rotation angle
A2 Rotation angle
AD Control
Bpp Bucket pilot pressure (pilot pressure for bucket operation)
Lpp Lift pilot pressure (pilot pressure for lift arm operation)
Od Excavation Object
Ph1 Insertion period
Ph2 Lift period
S1 Stroke amount
S2 Stroke amount
V Velocity
α Acceleration

The invention claimed is:

1. A work vehicle comprising: a vehicle body; a lift arm having one end pivotably attached to the vehicle body; a bucket pivotably attached to the other end of the lift arm; an acceleration sensor that detects acceleration of the vehicle body; a lift-amount detection sensor that detects lift amount of the lift arm; a tilt-amount detection sensor that detects tilt amount of the bucket; and a controller that controls the bucket and the lift arm, the controller keeps the tilt amount detected by the tilt-amount detection sensor while increasing the lift amount when the work vehicle meets an entry condition to an excavation object, where acceleration detected by the acceleration sensor becomes negative, the controller keeps the tilt amount while increasing the lift amount when an acceleration condition that the acceleration becomes positive is met after the work vehicle meets an insertion condition to the excavation object, where acceleration detected by the acceleration sensor first becomes positive, the controller keeps the lift amount while increasing the tilt amount when a deceleration condition that the acceleration becomes negative is met after the work vehicle meets the insertion condition to the excavation object, where acceleration detected by the acceleration sensor first becomes positive, and the controller ends control of the lift amount and the tilt amount when an end condition that the lift amount detected by the lift-amount detection sensor and the tilt amount detected by the tilt-amount detection sensor reach respective specified values is met.

2. The work vehicle according to claim 1, wherein the controller starts the control when a predetermined preliminary condition is met.

3. The work vehicle according to claim 2, further comprising a velocity sensor that detects velocity of the vehicle body, and the controller determines that the preliminary condition is met when at least velocity detected by the velocity sensor, lift amount detected by the lift-amount detection sensor, and tilt amount detected by the tilt-amount detection sensor are each within a predetermined range.

4. The work vehicle according to claim 1, wherein the controller stops the control when a predetermined stop condition is met.

5. The work vehicle according to claim 1, further comprising an automatic excavation switch for executing the control, wherein the controller executes the control when the automatic excavation switch is on.

6. The work vehicle according to claim 1, further comprising:

a hydraulic pump that discharges pressure oil;

a lift cylinder that operates the lift arm with pressure oil discharged from the hydraulic pump; a bucket cylinder that operates the bucket with pressure oil discharged from the hydraulic pump; a pilot pump; a pilot valve for lift arm operation that generates pilot pressure for lift arm operation in accordance with a command from the controller, with pressure oil discharged from the pilot pump as a pressure source; a pilot valve for bucket operation that generates pilot pressure for bucket operation in accordance with a command from the controller, with pressure oil discharged from the pilot pump as a pressure source; a directional control valve for lift arm that controls the lift arm based on the pilot pressure for lift arm operation; and a directional control valve for bucket that controls the bucket based on the pilot pressure for bucket operation, wherein from a time when the work vehicle meets an entry condition for the excavation object, where the acceleration detected by the acceleration sensor becomes negative, to a time when the work vehicle meets the insertion condition for the excavation object, where the acceleration detected by the acceleration sensor first becomes positive, the controller controls to increase the pilot pressure for bucket operation, and also controls the pilot valve so as to keep the pilot pressure for lift arm operation capable of increasing the lift amount;

when an acceleration condition that the acceleration becomes positive is met after the work vehicle meets the insertion condition to the excavation object, where acceleration detected by the acceleration sensor first becomes positive, the controller controls the pilot valve for bucket operation so as to decrease the pilot pressure for bucket operation within a range capable of keeping the tilt amount, and also controls the pilot valve for lift arm operation so as to increase the pilot pressure for lift arm operation and thus further increase the lift amount; and when a deceleration condition that the acceleration becomes negative is met after the work vehicle meets the insertion condition to the excavation object, where acceleration detected by the acceleration sensor first becomes positive, the controller controls the pilot valve for lift arm operation so as to decrease the pilot pressure for lift arm operation within a range capable of keeping the lift amount, and also controls the pilot valve for bucket operation so as to increase the pilot pressure for bucket operation and thus increase the tilt amount.

7. The work vehicle according to claim 6, further comprising at least one of an angle sensor that detects a rotation angle of the lift arm relative to the vehicle body and a stroke sensor that detects stroke amount of the lift cylinder, wherein the controller calculates the lift amount based on at least one of the rotation angle detected by the angle sensor and the stroke amount detected by the stroke sensor.

8. The work vehicle according to claim 6, further comprising at least one of an angle sensor that detects a rotation angle of a bellcrank relative to the lift arm and a stroke sensor that detects stroke amount of the bucket cylinder, wherein the controller calculates the tilt amount based on at least one of the rotation angle detected by the angle sensor and the stroke amount detected by the stroke sensor.

* * * * *